US005788892A

United States Patent [19]

Graf

[11] Patent Number: 5,788,892

[45] Date of Patent: Aug. 4, 1998

[54] METHOD AND APPARATUS FOR PRODUCING PARTICLE BOARDS

[75] Inventor: Matthias Graf, Smyma, Ga.

[73] Assignee: Machinenfabrik J. Dieffenbacher GmbH & Co., Eppingen, Germany

[21] Appl. No.: 865,270

[22] Filed: May 29, 1997

[30] Foreign Application Priority Data

Jun. 3, 1996 [DE] Germany ..... 196 22 279.6

[51] Int. Cl.[6] ..... B27N 3/24; B30B 5/06

[52] U.S. Cl. ..... 264/120; 264/109; 425/371

[58] Field of Search ..... 264/120, 109; 425/371

[56] References Cited

U.S. PATENT DOCUMENTS

| | | | |
|---|---|---|---|
| 4,923,656 | 5/1990 | Held | 264/70 |
| 5,085,812 | 2/1992 | Ahrweiler et al. | 264/37 |
| 5,284,609 | 2/1994 | Avenne | 264/101 |
| 5,433,905 | 7/1995 | Tisch | 264/83 |
| 5,562,028 | 10/1996 | Bielfeldt et al. | 425/371 |

OTHER PUBLICATIONS

Bullervelt et al., Abstract No. DE 44 05 342 A (1994).

*Primary Examiner*—Mary Lynn Theisen
*Attorney, Agent, or Firm*—Foley & Lardner

[57] ABSTRACT

A continuously operating press having a plurality of press columns each including upper and lower press heating plates being separated by an adjustable press nip, a piston-cylinder arrangement connected to both the upper and lower press heating plates and a spring supporting the press column achieves an increased longitudinal deformation gradient of the press heating plates. The press achieves the increased longitudinal deformation gradient by deforming the upper and lower press heating plates together.

20 Claims, 5 Drawing Sheets

METHOD AND APPARATUS FOR PRODUCING PARTICLE BOARDS

BACKGROUND OF THE INVENTION

1. Field of the Invention

The invention relates to a method of producing particleboards, fiberboards or similar wooden-material boards and plastic sheets, and to a continuously operating press for carrying out the method.

2. Description of the Related Art

DE-A 44 05 342 discloses a continuously operating press for producing particleboards, fiberboards or similar wooden-material boards and plastic sheets. With this press, it is possible, longitudinally and transversely along the pressing path between the upper and lower press heating plates, to control or adjust a change in the press nip distances hydro-mechanically both in the idling mode prior to entry of the material to be pressed (start-up mode) and also in the loaded mode during production, using an on-line method in a few seconds.

The solution provided in DE-A 44 05 342 has proved to be practicable. The significant part of this solution is the elastic-nonpositive suspension or connection of the upper press heating plate to the upper press ram, which can be flexibly controlled hydro-mechanically, and the elastic-nonpositive suspension or connection of the lower press heating plate to the lower, stationary press table, on which one or more hydraulic short-stroke plunger cylinders are arranged per press frame or press frame structure and transversely and concentrically with respect to the convex bending deformation.

A drawback of the method by which the continuously operating press according to DE-A 44 05 342 operates is that the longitudinal bending deformation of the press heating plates in the relaxation section c of the pressing path sections a, b, c, d and e, as required particularly in the production of fiberboards (MDF) with a low apparent density of about $\leqq 500$ kg/m$^3$, is not sufficiently controllable, meaning that, in such a press, only a longitudinal deformation gradient of 2 mm/m is possible without damaging the structural parts, because a longitudinal deformation can be set only by means of the upper press heating plate.

SUMMARY OF THE INVENTION

An object of this invention is to provide a method and a continuously operating press, by means of which the longitudinal deformation gradient of the press heating plates can be increased.

The above object is accomplished by a continuously operating press comprising first and second press heating plates being separated by an adjustable press nip; a piston-cylinder arrangement operably connected to both the first and second press heating plates for producing an actuation force to deform the first press heating plate in a first direction and a reaction force to deform the second press heating plate in a second direction opposite to the first direction; and a spring supporting the first and second press heating plates and the piston-cylinder arrangement on a support structure for the press.

The above object is further accomplished in accordance with the invention by a method of producing particleboards, fiberboards or similar wooden-material boards and plastic sheets using a continuously operating press comprising a plurality of press columns each having upper and lower press heating plates defining a press nip therebetween and a press cylinder-piston arrangement for adjusting the press nip. The method comprises the steps of actuating the press cylinder-piston arrangement to adjust the press nip and deforming the upper and lower press heating plates together to change the press nip.

Additional objects, features and advantages of the invention will be set forth in the description of preferred embodiments which follows.

BRIEF DESCRIPTION OF THE DRAWINGS

The invention is described in detail herein with reference to the drawings in which.

Figure 1:
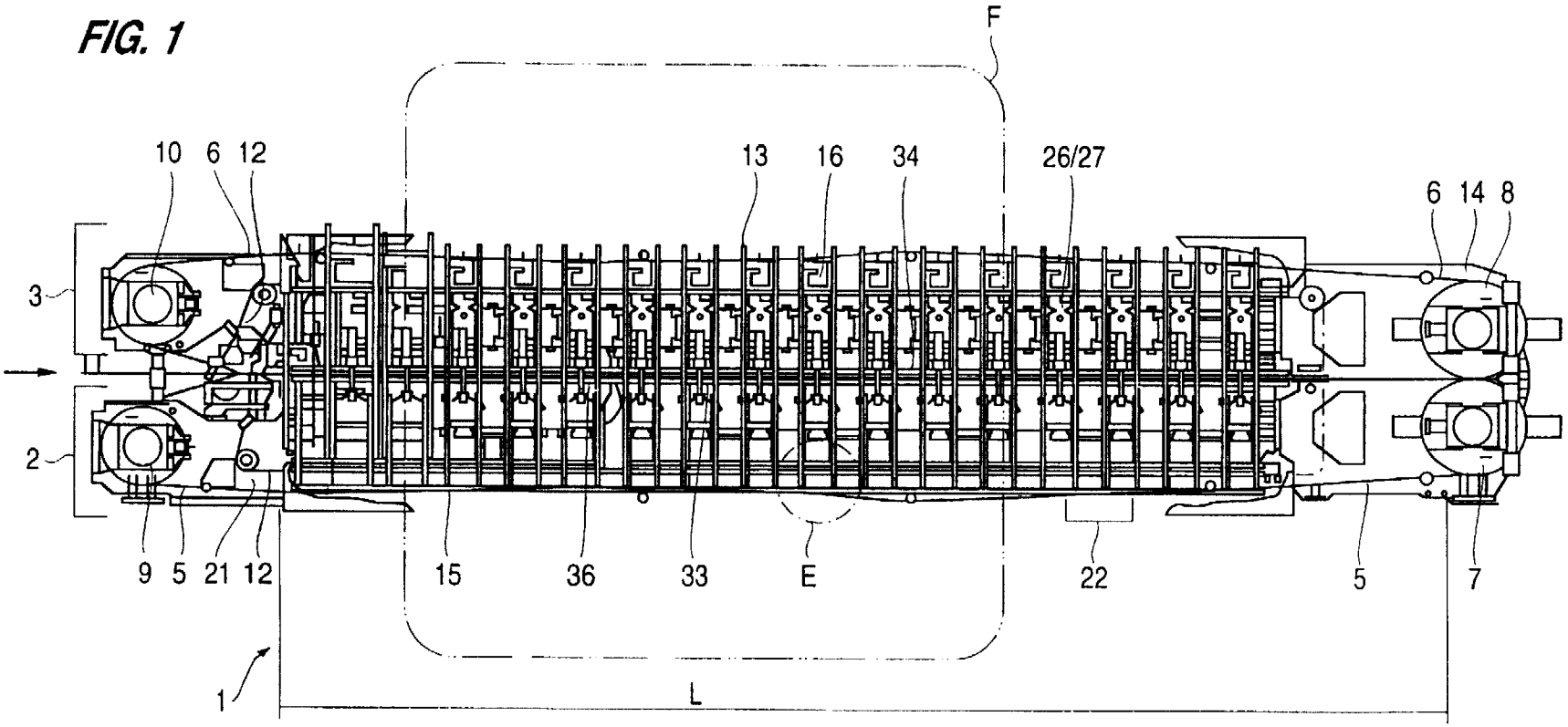
FIG. 1 shows a side view of a continuously operating press according to the invention.

The accompanying drawings, which are incorporated in and constitute a part of the specification, illustrate presently preferred exemplary embodiments of the invention, and, together with the general description given above and the detailed description of the preferred embodiments given below, serve to explain the principles of the invention.

DETAILED DESCRIPTION OF THE PREFERRED EMBODIMENT

A continuously operating press having a plurality of press columns each including upper and lower press heating plates being separated by an adjustable press nip, a piston-cylinder arrangement connected to both the upper and lower press heating plates, and a spring supporting the press column achieves an increased longitudinal deformation gradient of the press heating plates. The press achieves the increased longitudinal deformation gradient by deforming the upper and lower press heating plates together.

The spring provides a resilient support of the weight of the continuously operating press along the pressing path sections b, c and d as a solution to increasing the longitudinal deformation gradient of the press heating plates. The resilient support allows the actuating forces of the press cylinders for setting the press nip to be effective virtually uniformly on both the upper and lower press heating plates, so that a deformation gradient which is about twice as large in the decompression and compression regions of, for example, the relaxation section c, can be controlled by the longitudinal deformation of both the upper and lower press heating plates.

The invention achieves above-identified object in the following manner. When the press nip is changed by means of the hydraulic press cylinders, for example, in accordance with a press nip enlargement in the relaxation section c in accordance with FIG. 3 and FIG. 5, as is necessary in process engineering terms when producing fiberboards (MDF), the upper and lower press heating plates are deformed symmetrically because of the free, virtually hanging suspension. In other words, when the hydraulic press cylinders apply actuating forces to the upper press heating plate to deform it in one direction, forces equal and opposite to the actuating forces are applied to the lower press heating plate to deform the lower press heating plate in an opposite direction as a result of the state of equilibrium achieved in the free, virtually hanging suspension. In conventional presses, by contrast, only the upper press heating plate is deformed because the lower press heating plate is supported via the web plates of the press table to the lower press carrier and no deformation stresses are transmitted to the lower press heating plate.

Without the inventive resilient support, the longitudinal deformation gradient, i.e., the amount of vertical deformation of the press heating plate at the top and bottom per meter of pressing path L, owing to the resulting deformation stresses and the bending deformation stresses due to the press compressive loading, can be adjusted only to a limited extent by adjusting the position of the hydraulic press cylinders. However, with the resilient support of the weight of the press frames and press heating plates along the pressing path sections b, c and d, as according to the invention, the upper and lower press heating plates become suspended. The spring assemblies beneath the press frames are pre-loaded with 98% partial weight component "GG", so that a virtually hanging state of the continuously operating press is set, supported via the supporting structure to the support carrier and base. When the nip distance is changed, for example, from y to $(y+y_1+y_2)$, by means of the hydraulic press cylinders, owing to the relative deformation of the press heating plates, the state of stresses of these press heating plates between the pressing path sections b, c and d alters, and in the pressing path sections b and d (FIG. 3) the press columns rise by about $[0.5\times(y_1+y_2)]$.

Figure 3:
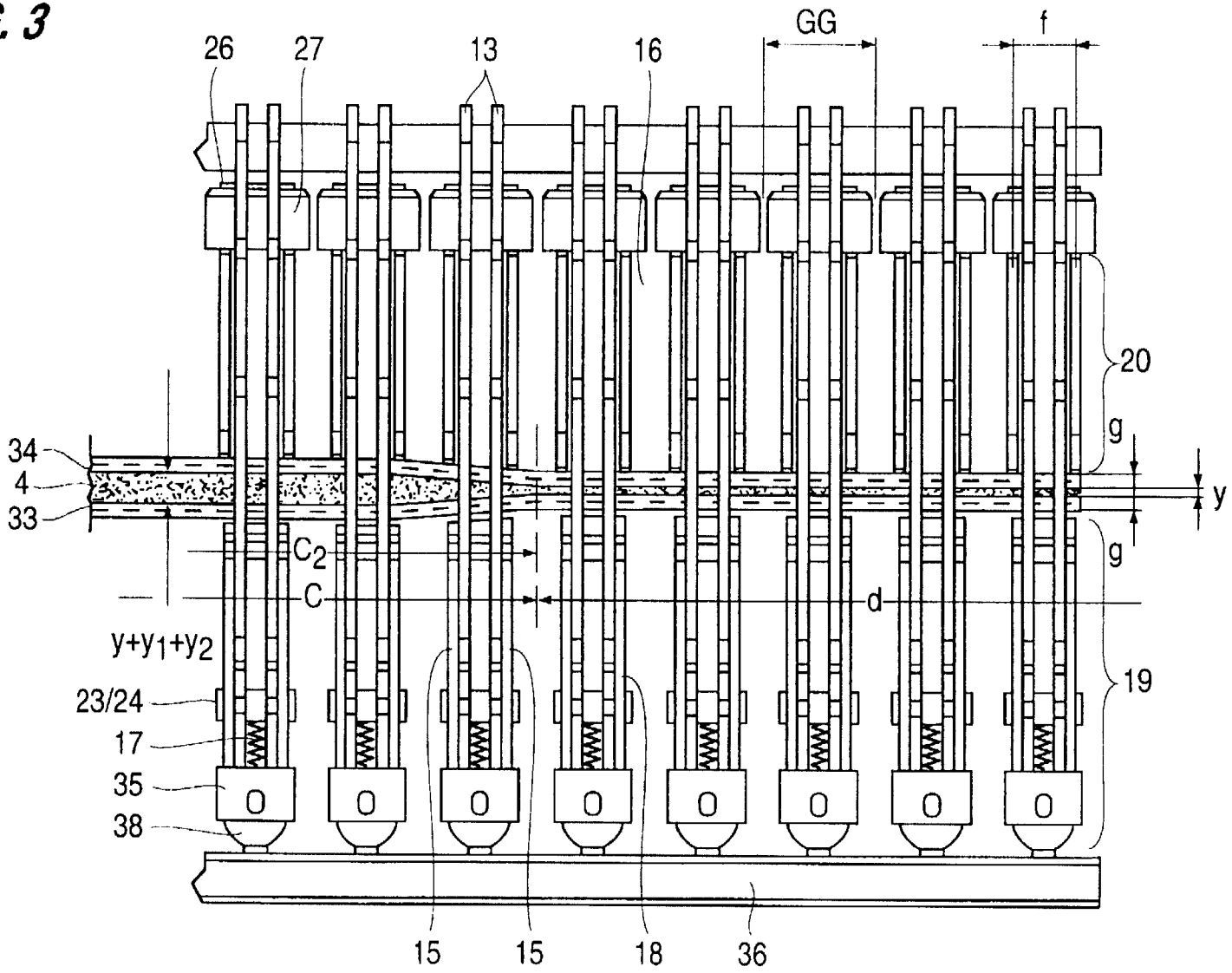
FIG. 3 shows, in an enlarged view of section F from FIG. 1, part of a relaxation section c with a compression section $c_2$.
Figure 4:
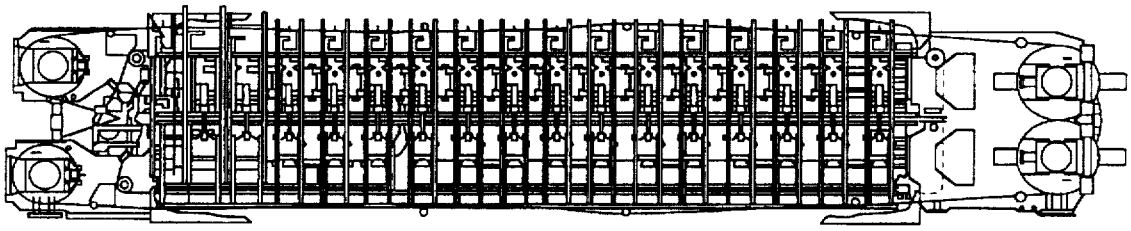
FIG. 4 shows the continuously operating press according to FIG. 1 on a reduced scale.
Figure 5:
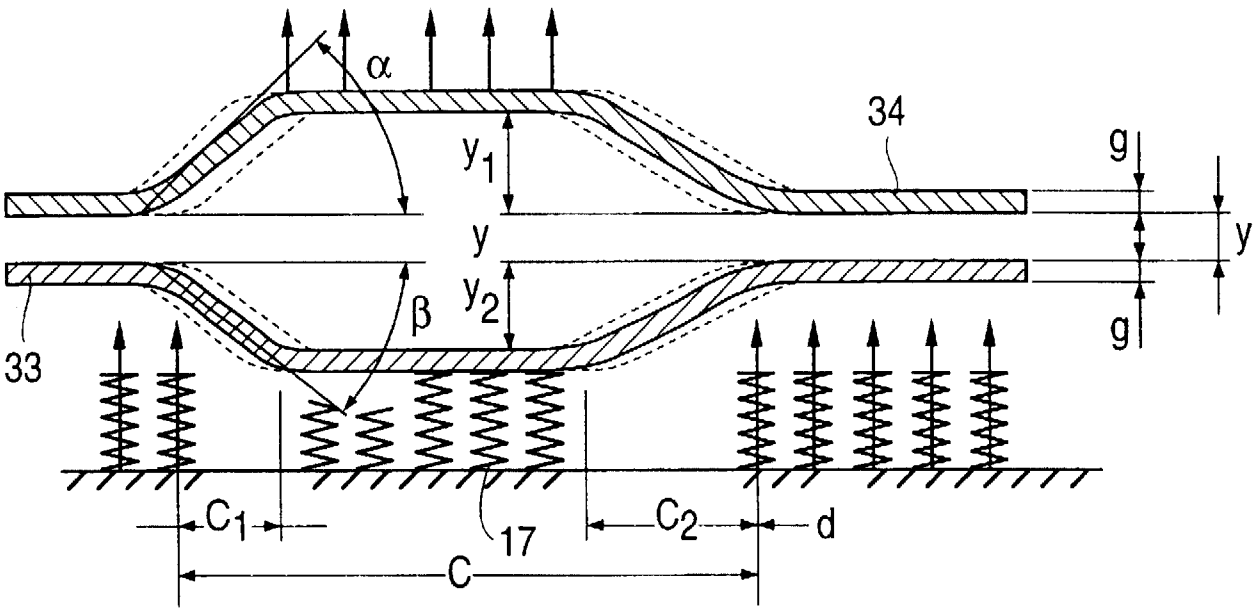
FIG. 5 depicts the deformation sections b, c and d on the upper and lower press heating plates.

A virtually symmetrical press nip setting will thus advantageously be set between the lower and upper press heating plates in accordance with FIGS. 3 and 5. Thus, in technical terms, a uniform relaxation of the compacted top layer is set at the end of the decompression section $c_1$, in the relaxation region c. In the same way, the top layer is compacted again symmetrically under renewed compression at the start of the compression section $c_2$, as a result of which, particularly in the case of extremely light fiberboards, an apparent density profile which is more uniform can be physically set.

Due to the uniform deformation of the press heating plates at the top and bottom, approximately twice the deformation travels can be advantageously set in process engineering terms as a result. In terms of deformation on such continuously operating presses, the prior art is a longitudinal deformation gradient of 2 mm/m. Twice the gradient, i.e. 4 mm/m, can be achieved by the invention. By optimizing the support distances f between the web plates of press table and press ram with respect to the lower and upper press heating plates, and also the press heating plate thickness g, gradients in the range of 6 mm to 8 mm can also be achieved.

The continuously operating press 1 for the method according to the invention comprises, in accordance with FIGS. 1 to 6, as its main components, a press table 2 and a vertically movable press ram 3, and tensioning brackets 13 connecting them in a positively locking manner. The tensioning brackets 13 can be released quickly by means of the bolts 24.

Entry crossbeams 21 and exit crossbeams 14 are arranged at end sides of the press table 2 and the press ram 3 and serve as anchoring and bearing location for drive rollers 7 and 8, deflecting rollers 9 and 10 and entry systems for roll bars 12. The press table 2 and the press ram 3 comprise web plates 15 and 16 and transverse ribs 18 connecting the web plates 15 and 16.

Two upper web plates 16 and two lower web plates 15, together with the tensioning brackets 13, form a press column 22. Press heating plates 33 and 34 placed next to one another are arranged to form the pressing path L of the continuously operating press 1. The tensioning brackets 13 are fixed on the press table 2 by means of bolts 24 which are anchored in eyelets 23 of the tensioning brackets 13 and the web plates 15.

The press table 2 comprises the web plates 15 which form a plurality of individual bars 19 (table module) and the press ram 3 comprises the web plates 16 which form a plurality of individual bars 20 (press ram module). The shoulders or protrusions projecting out of the web plates 16 on the left and right act as abutments for raising and lowering of the press ram 3. Press cylinder-piston arrangements 26/27 are arranged in openings in the tensioning brackets 13.

It can further be seen from FIG. 1 how the deflecting rollers 9 and 10 form the entry nip 11 and how the roll bars 12, which are guided with steel bands 5 and 6 around the press table 2 and the press ram 3, are supported against the press heating plates 33 and 34. That is to say, the revolving roll bars 12, as an example of a rolling support, are arranged between the press heating plates 33 and 34 and the steel bands 5 and 6 so as to roll along with them.

The material 4 to be pressed is drawn through the press nip y together with the steel bands 5 and 6, which are driven by the drive rollers 7 and 8, and is pressed into boards. It may be expedient for there to be no resilient weight support in the central region of the relaxation section c, since lifting is not required in this region.

Figure 2:
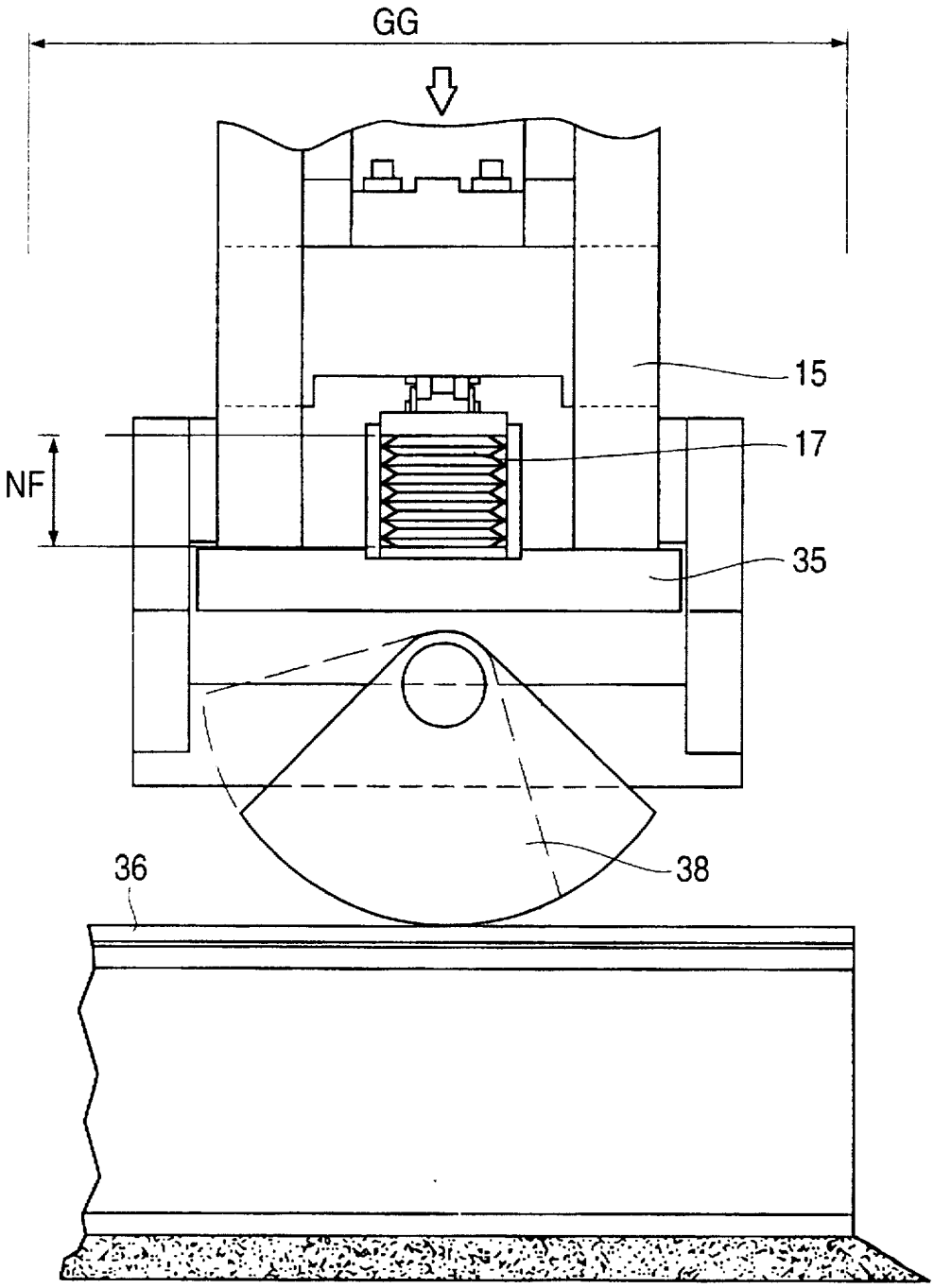
FIG. 2 shows, in an enlarged view of section E from FIG. 1, a press column support.

The elastic spring support of the press heating plates 33 operates in accordance with FIG. 2, in that preloaded springs 17 are fixed between support structure 35 for rolling wheel segments 38 and the press column 22. The preloading NF of these springs 17 is $\leqq 100\%$, in practice about 98%, of the partial dead weight GG of 100%, as shown in FIG. 2. In other words, with a parallel press nip distance y between the lower press heating plate 33 and the upper press heating plate 34, the lower press heating plate 33 is held in a planar manner over all the pressing path sections a, b, d and e as shown in FIGS. 3 to 6, since the total weight of all the press columns 22 with the press heating plates 33/34 at the top and bottom is about 2% greater than the sum of the preloading forces of the preloaded springs 17.

In the event of a change, e.g., in the event of the press nip being increased by $y_1+y_2$ between the press heating plates 33 and 34 in the relaxation section c as a result of the actuation of the press cylinders 27, the upper press heating plate 34 is raised by about half the widening of the press nip and the lower press heating plate 33 is lowered by about half the widening of the press nip, so that essentially in accordance with FIG. 5, a symmetrical change in the press nip is set in the relaxation and the compression region.

Figure 6:
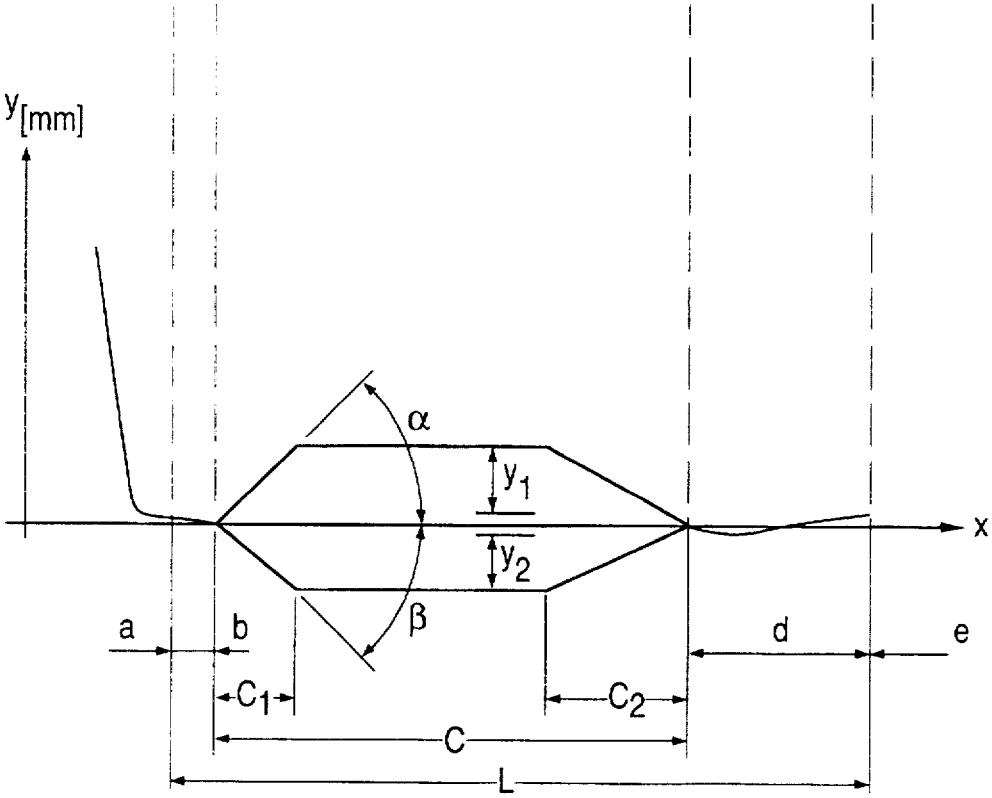
FIG. 6 shows a pressing path/press nip diagram.

The spherical control of the deformation of the press heating plates 33 and 34 longitudinally and transversely can be effected on-line by controlling a corresponding press nip curve in accordance with FIG. 6 in idling mode or under pressure of the press without internal pressure of the material to be pressed. In this case, the rolling wheel segments 38 serve to allow the press columns 22 to roll on the supporting carriers 36 or to move freely in the event of an expansion or shrinkage of the press heating plates 33 and 34.

By means of the elastic spring support (see FIG. 2) which can be a mechanical spring or a hydraulic spring, an increase in the longitudinal deformation, which can be approximately up to twice as large, is achieved (see FIGS. 5 and 6).

The solution according to the invention is also beneficial for producing ultralightweight boards. In particular, after initial compaction, in the decompression section $c_1$, highly compact top layers are formed. Accordingly, a reduction in the pressing factor (by about 10%) results, particularly during second compaction in section $c_2$, because more press length is available in the pressing path sections b+d for supplying thermal energy under pressure due to the steeper deformation gradient [tanα+tanβ] as shown in FIG. 6. Hence, as the sum of deformation gradients of [tanα+tanβ], a total longitudinal deformation gradient in the range from 0 to about 8 mm/m can be set.

The start of relaxation and compression can be controlled optimally on-line along the entire press length in accordance with the thickness and/or the density of the material to be pressed, in a manner correlated to the change in speed of the steel band, so that ultralightweight boards can be produced in a very wide range of thicknesses, always with the most optimal pressing factor, i.e., economically.

While particular embodiments according to the invention have been illustrated and described above, it will be clear that the invention can take a variety of forms and embodiments within the scope of the appended claims.

The disclosure of German patent application DE 196 22 279.6, filed Jun. 3, 1996, is hereby incorporated by reference in its entirety.

What is claimed is:

1. A method of producing particleboards, fiberboards or similar wooden-material boards and plastic sheets using a continuously operating press comprising a plurality of press columns each having first and second press heating plates defining a press nip therebetween and a press cylinder-piston arrangement for adjusting the press nip, said method comprising the steps of:

actuating the press cylinder-piston arrangement to adjust the press nip; and deforming the first and second press heating plates together to change the press nip.

2. The method according to claim 1, wherein the first and second press heating plates correspond respectively to upper and lower heating plates, and are deformed in opposite directions.

3. The method according to claim 2, wherein the step of deforming is responsive to the step of actuating.

4. The method according to claim 3, wherein the step of deforming results in a longitudinal deformation gradient which is about 4 mm/m.

5. The method according to claim 3, wherein the step of deforming results in a longitudinal deformation gradient which is between 4 mm/m and 8 mm/m.

6. The method according to claim 1, further comprising the step of supporting each press column on a preloaded mechanical spring.

7. The method according to claim 6, wherein the step of supporting includes preloading the mechanical spring to be about 98% of the partial dead weight of the press column.

8. The method according to claim 1, further comprising the step of supporting each press column on a preloaded hydraulic spring.

9. The method according to claim 8, wherein the step of supporting includes preloading the hydraulic spring to be about 98% of the partial dead weight of the press column.

10. The method according to claim 1, further comprising the step of supporting each press column on a spring except for the press columns in a central relaxation zone of the press.

11. A continuously operating press comprising:

first and second press heating plates being separated by an adjustable press nip;

a piston-cylinder arrangement operably connected to both the first and second press heating plates for producing an actuation force to deform the first press heating plate in a first direction and a reaction force to deform the second press heating plate in a second direction opposite to the first direction; and a spring supporting the first and second press heating plates and the piston-cylinder arrangement on a support structure for the press.

12. The press according to claim 11, wherein the first and second heating plates correspond respectively to upper and lower heating plates and the deformation of the first and second heating plates is substantially symmetrical.

13. The press according to claim 12, further comprising flexible, endless bands which pull materials to be pressed through the press and transmit pressing pressure to the materials, the bands being driven between the first and second press heating plates.

14. The press according to claim 11, wherein the spring comprises a mechanical spring.

15. The press according to claim 11, wherein the spring comprises a hydraulic spring.

16. The press according to claim 11, further comprising a plurality of press columns, wherein each press column includes a respective one of said first and second press heating plates, said cylinder-piston arrangement, and said spring.

17. The press according to claim 16, wherein the spring of each press column is preloaded to be about in 98% of the partial dead weight of the press column.

18. The press according to claim 11, further comprising:

an upper web plate for deforming the first press heating plate; and a lower web plate for deforming the second heating plate.

19. The press according to claim 18, wherein the cylinder-piston arrangement includes a piston and a cylinder body, and wherein the upper web plate is responsive to a motion of the cylinder body and the lower web plate is responsive to a motion of the piston.

20. The press according to claim 19, further comprising a tensioning bracket supported by the piston and connected to the lower web plate.

* * * * *